United States Patent [19]

Osenkowski

[11] Patent Number: 4,895,403

[45] Date of Patent: Jan. 23, 1990

[54] FLUSH DOOR HANDLE

[75] Inventor: Joseph M. Osenkowski, Detroit, Mich.

[73] Assignee: General Motors Corporation, Detroit, Mich.

[21] Appl. No.: 217,590

[22] Filed: Jul. 1, 1988

[51] Int. Cl.[4] ..... E05B 3/00

[52] U.S. Cl. ..... 292/336.3; 16/110 R; 292/DIG. 31; 292/DIG. 63

[58] Field of Search ..... 16/110 R, 115, 124; 70/208, 209; 292/336.3, 347, DIG. 30, DIG. 31, DIG. 63

[56] References Cited

U.S. PATENT DOCUMENTS

| | | | |
|---|---|---|---|
| 2,131,033 | 9/1938 | Barrington et al. | 70/208 |
| 2,164,150 | 6/1939 | Brewster | 70/208 |
| 2,208,818 | 7/1940 | Schaffler . | |
| 2,237,949 | 4/1941 | Palmer . | |
| 2,488,213 | 11/1949 | Lutz et al. . | |
| 2,497,624 | 2/1950 | Nelson . | |
| 2,599,054 | 6/1952 | Gates et al. . | |
| 2,752,186 | 6/1956 | Morrison | 292/DIG. 31 X |
| 4,510,779 | 4/1985 | Ahad | 70/208 |
| 4,588,219 | 5/1986 | Kobayashi et al. | 292/336.3 |

*Primary Examiner*—Lloyd A. Gall

*Attorney, Agent, or Firm*—Charles E. Leahy

[57] ABSTRACT

A door handle in which the handle bar is first pushed inwardly about one pivot axis to permit the user to grip the handle, and then the handle bar is pulled outwardly about a second pivot axis in order to unlatch the door. Springs normally establish the handle bar at a normal position substantially filling the recess and are yieldable to permit the inward swinging movement of the handle about the first pivot axis and the pulling of the door handle outwardly about the second pivot axis.

2 Claims, 10 Drawing Sheets

FLUSH DOOR HANDLE

The invention relates to an exterior door handle for a vehicle body and more particularly provides a handle which is depressed to swing inwardly to permit gripping by the user for subsequent outward swinging movement to unlatch the door.

BACKGROUND OF THE INVENTION

It is well known in motor vehicles to provide a door handle mounted on the exterior of the door by which the user may unlatch the door latch in order to open the door and enter the vehicle.

It is desirable to provide such an exterior door handle which fits flush with the exterior skin of the vehicle in order to be aerodynamically efficient and aesthetically pleasing.

Heretofore it has been customary to provide a handle bar which is mounted within a recess in the door panel. The door panel recess is larger than the dimension of the handle bar so that the user may insert his fingers beneath the handle bar in order to lift the handle bar and unlatch the door.

It has also been known to provide a push bar which fully occupies the recess in the door which is pushed inwardly to release the latch. However, it is awkward to use such an inwardly pushing handle bar to pull the door outwardly to the open position.

SUMMARY OF THE INVENTION

The present invention provides a new and improved door handle in which the handle bar is first pushed inwardly about one pivot axis to permit the user to grip the handle, and then the handle bar is pulled outwardly about a second pivot axis in order to unlatch the door. Springs normally establish the handle bar at a normal position substantially filling the recess and are yieldable to permit the inward swinging movement of the handle about the first pivot axis and the pulling of the door handle outwardly about the second pivot axis.

BRIEF DESCRIPTION OF THE DRAWING

These and other features, objects and advantages of the invention will become apparent upon consideration of the specification and appended drawings in which.

DESCRIPTION OF THE PREFERRED EMBODIMENT

Figure 1:
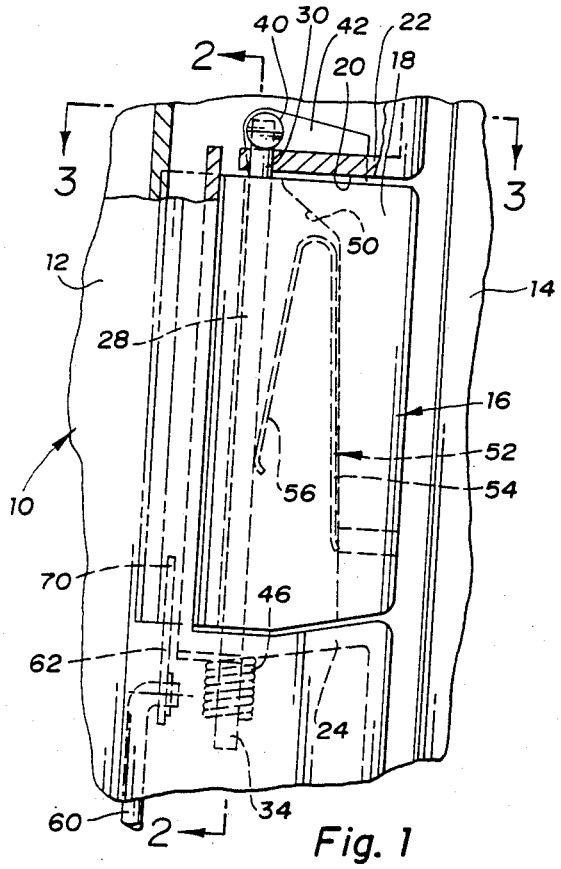
FIG. 1 is a side elevation view of a vehicle door having a flush mounted door handle according to the present invention.

Referring to FIG. 1, there is shown a vehicle body 10 including a door 12 hingedly mounted on the vehicle body 10 and latched to a door pillar 14 by a door latch, not shown. The door latch is released by a flush mounted door handle mechanism generally indicated at 16.

Figure 2:
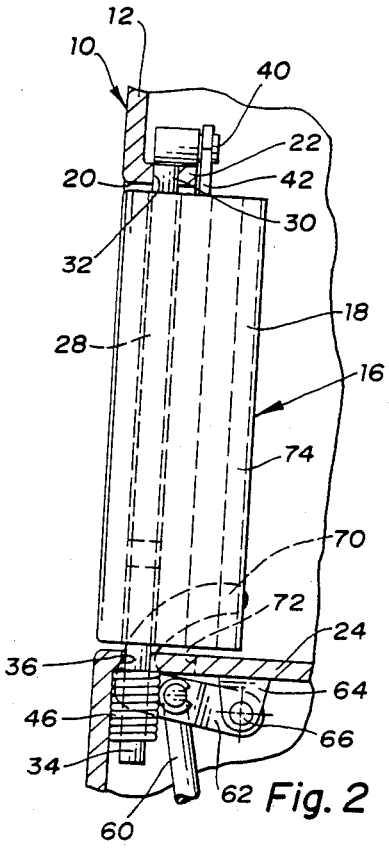
FIG. 2 is an end view of the door handle taken in the direction of arrows 2—2 of FIG. 1.

The door handle mechanism 16 includes a handle bar 18 of generally rectangular shape mounted within a recess 20 in the trailing edge of the door 12. As best seen in FIG. 2, the recess 20 is defined by an inwardly turned flange 22 at the upper edge and an inwardly turned flange 24 at the lower edge. Flanges 22 and 24 may be integral with the outer skin of the door 12, or may be provided on a reinforcing structure or frame underlying the skin. A pivot shaft 28 has an upper end 30 which extends through an aperture 32 in the upper flange 22 and a lower end 34 which extends through an aperture 36 in the lower flange 24. The shaft 28 is rotatable within the apertures 32 and 36. The handle bar 18 is mounted on the top end of the pivot shaft 28 by a pivot pin 40 which is welded or otherwise suitably attached to the top end of pivot shaft 28. A tab 42 is welded or otherwise suitably attached to the handle bar 18 and has an aperture which fits rotatably on the pivot pin 40 so that the handle bar 18 can swing about the pivot pin 40.

As best seen in FIG. 2, a coil torsion spring 46 surrounds the lower end 34 of the pivot shaft 28 and has one end attached to the pivot shaft 28 and the other end attached to the flange 24. The torsion spring 46 establishes the pivot shaft 28 at a normal rotary position in which the pivot shaft 28 and its pivot pin 40 will establish the handle bar 18 at its normal position of FIGS. 1, 2 and 3 in which the handle bar 18 fills the recess 20.

Figure 3:
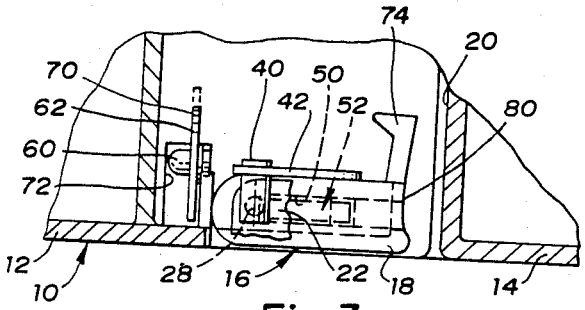
FIG. 3 is a top view taken from above the door handle in the direction of arrows 3—3 of FIG. 1.
Figure 4:
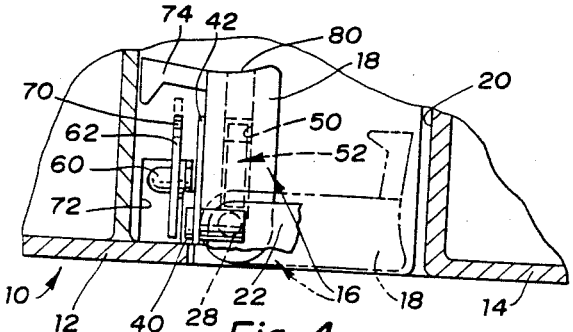
FIG. 4 is a view similar to FIG. 3 but showing the handle bar having been swung inwardly to permit gripping of the handle bar.
Figure 5:
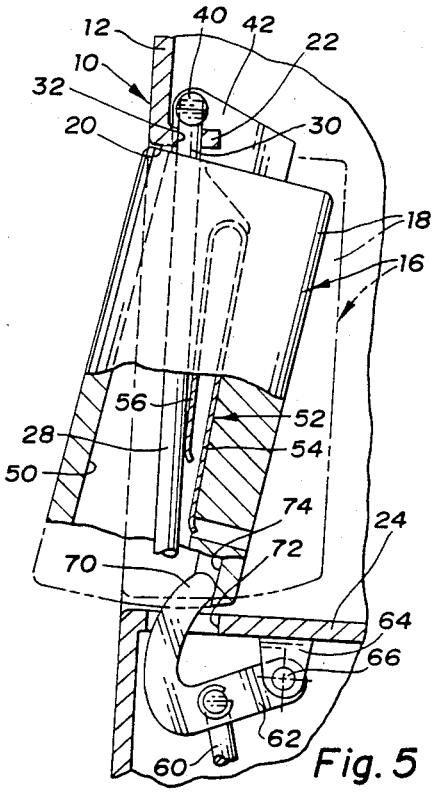
FIG. 5 is a view similar to FIG. 2 but showing the handle bar swung inwardly as in FIG. 4 and also pulled outwardly to unlatch the door.

Referring to FIGS. 3 and 5, it is seen that the handle bar 18 has a cavity 50 therein which receives the pivot shaft 28 and also captures a hairpin spring 52, best seen in FIG. 5. The hairpin spring 52 includes a leg 54 which bears against the handle bar 18 and a leg 56 which bears against the pivot shaft 28. The hairpin spring 52 functions to establish the handle 18 at a normal rotary position with respect to the pivot pin 40 as shown in FIGS. 1, 3 and 4.

The handle bar 18 is operably associated with the door latch, not shown, by a latch rod 60 which is pivoted to a trigger arm 62. The trigger arm 62 is pivotally mounted on a mounting bracket 64 of the lower flange 24 by a pivot 66. The trigger arm 62 includes a follower portion 70 which reaches through an aperture 72 of the flange 24 and into proximity with an actuating arm 74 provided within the cavity 50 of handle bar 18.

Operation

As best seen in FIGS. 1, 2 and 3, the handle bar 18 is normally established at a position substantially filling the recess 20 and flush with the outer surface of the door 12 to be aerodynamically efficient and aesthetically pleasing.

When the user wishes to enter the vehicle, the user pushes inwardly on the trailing edge of the handle bar 18 which swings the handle bar 18 inwardly about the axis of pivot shaft 28 from the position of FIG. 3 to the position of FIG. 4. This inward swinging movement of the handle bar 18 about the vertical axis provided by pivot shaft 28 permits the user's fingers to enter the recess 20 and grip a concave handle surface 80 provided on the handle bar 18. This inward swinging movement of handle 18 is permitted by yielding of the torsion spring 46. After gripping the handle surface 80 of the handle bar 18, the user then pulls the handle bar 18 outwardly as permitted by pivoting of the handle bar 18 about the pivot pin 40 and yielding of the hairpin spring 52. This outward pivoting movement of the handle bar 18 about the pivot axis defined by pivot pin 40, as shown in FIG. 5, causes the actuating arm 74 of the handle bar 18 to displace the trigger arm 62 from its normal position of FIG. 2 to its depressed position of FIG. 5 in which the push rod 60 has been moved downwardly to operate the door latch.

The user then pulls on the handle bar 18 to swing the door 12 outwardly about its pivot axis to permit the user's entry into the motor vehicle.

When the user releases the handle bar 18 and removes his fingers from the recess 20, the torsion spring 46 and the hairpin spring 52 will function to return the handle bar 18 to its normal flush position with respect to the outer surface of the door.

Thus it is seen that the invention provides a new and improved door handle arrangement in which the handle is first depressed about one axis to permit gripping of the handle, and then the handle is pulled outwardly about a second axis to unlatch the door.

In the preferred embodiment shown in the drawings, the axis for inward swinging of the handle is a vertical axis and the axis for outward pulling of the handle bar is a horizontal axis. However, it will be understood that the axes could be reversed so that the handle bar would extend in the horizontal direction so that the handle bar would be depressed inwardly about a horizontal axis and then pulled outwardly about the vertical axis.

Furthermore, although the drawing shows the handle bar is located at the rear edge of the door, the handle bar could be located away from the edge of the door or, could be located on the pillar instead of on the door.

The embodiments of the invention in which an exclusive property or privilege is claimed are defined as follows:

1. A door handle adapted to seat within a recess and fit flush with the exterior of a vehicle body comprising:

a handle bar of generally rectangular shape substantially filling the recess to present a flush concealed relationship with the vehicle exterior;

a pivot shaft located within the recess and being mounted on the body for rotation about the axis of the pivot shaft;

a handle bar pivot carried by the pivot shaft and having the handle bar mounted thereon for pivoting movement with respect to the pivot shaft so that the handle bar may be depressed to pivot the handle bar and the handle bar pivot about the axis of the pivot shaft to permit the handle bar to swing into the recess to be gripped so that the handle bar may then be pivoted by pulling the handle bar outwardly to pivot about the handle bar pivot;

and latch operating means actuated by the pivoting of the handle bar with respect to the pivot shaft.

2. A door handle adapted to seat within a recess and fit flush with the exterior of a vehicle body comprising:

a handle bar of generally rectangular shape substantially filling the recess to present a flush concealed relationship with the vehicle exterior;

a pivot shaft traversing the recess and being mounted on the body for rotation about the axis of the pivot shaft;

a handle bar pivot carried by the pivot shaft and having the handle bar mounted thereon for pivoting movement with respect to the pivot shaft;

first spring means acting on the pivot shaft to establish a normal rotary location of the pivot shaft in which the handle bar fills the recess and being yieldable to permit depression of the handle bar to swing the handle bar inwardly into the recess;

and second spring means acting on the handle bar to establish a normal rotary location of the handle bar with respect to the pivot shaft in which the handle bar fills the recess and permits pulling of the handle bar to swing the handle bar outwardly of the recess;

and latch operating means actuated by the pivoting of the handle bar with respect to the pivot shaft.

* * * * *